US005806389A

United States Patent [19]

McGuigan

[11] Patent Number: 5,806,389

[45] Date of Patent: Sep. 15, 1998

[54] EL LAMP WITH BEVELED EDGE

[75] Inventor: Ralph M. McGuigan, Phoenix, Ariz.

[73] Assignee: Durel Corporation, Chandler, Ariz.

[21] Appl. No.: 663,387

[22] Filed: Jun. 13, 1996

[51] Int. Cl.[6] ..... B26D 7/14

[52] U.S. Cl. ..... 83/20; 83/21; 83/946

[58] Field of Search ..... 83/20, 21, 946

[56] References Cited

U.S. PATENT DOCUMENTS

| | | | |
|---|---|---|---|
| 349,388 | 9/1886 | Fowler | 83/21 |
| 5,184,969 | 2/1993 | Sharpless et al. | 445/24 |
| 5,309,060 | 5/1994 | Sharpless et al. | 313/511 |
| 5,491,379 | 2/1996 | Daigle et al. | 313/509 |
| 5,583,394 | 12/1996 | Burbank et al. | 313/498 |

FOREIGN PATENT DOCUMENTS

| | | | |
|---|---|---|---|
| 614659 | 5/1935 | Germany | 83/21 |

*Primary Examiner*—Maurina T. Rachuba
*Attorney, Agent, or Firm*—Paul F. Wille

[57] ABSTRACT

An EL lamp has a perimeter that is beveled and said rear electrode is smaller in area than said front electrode due to said bevel. The lamp is made by placing an EL panel on a concave die with the rear electrode in contact with the die and shearing the edge of the lamp at an acute angle. The angle is between 30° and 60° and is preferably 45°. The die has a radius of curvature that is 50–150 times the thickness of the panel to prevent deformation of the panel. For circular or nearly circular lamps, the entire perimeter of the lamp can be cut in a single stroke.

7 Claims, 1 Drawing Sheet

EL LAMP WITH BEVELED EDGE

BACKGROUND OF THE INVENTION

This invention relates to an electroluminescent (EL) lamp and, in particular, to an EL lamp in which the rear electrode is smaller than the front electrode, thereby minimizing short circuits between the electrodes.

An electroluminescent (EL) lamp is essentially a capacitor having a dielectric layer between two conductive electrodes, one of which is transparent. The dielectric layer includes a phosphor powder or there is a separate layer of phosphor powder adjacent the dielectric layer. The phosphor powder radiates light in the presence of a strong electric field, using very little current.

The front electrode is typically a thin, transparent layer of indium tin oxide or indium oxide on a substrate such as a sheet of polyester or polycarbonate, which provides mechanical support for the other layers. Such coated sheets are commercially available. An EL lamp is typically made by screen printing a phosphor layer on the front electrode, then screen printing a dielectric layer on the phosphor layer, and then screen printing a rear electrode on the dielectric layer. Individual lamps are made by cutting or punching the sheet.

The front and rear electrodes are separated only by the thickness of the phosphor layer and the dielectric layer. The cutting or punching operation may deform the layers, bringing the front electrode into contact with the rear electrode or reducing the separation of the electrodes to the point that normal operating voltages can cause an arc across the gap between the layers. Even if the layers are not deformed, moisture absorbed along the exposed edge, or contact with a conductive surface such as the case of a wristwatch, can cause a short circuit.

One can pattern a rear electrode during screen printing to make the rear electrode smaller than the nominal lamp dimensions, referred to in the art as "pullback" or "setback." For example, U.S. Pat. No. 5,491,379 (Daigle et al.) discloses an EL lamp with the rear electrode printed smaller than the front electrode and smaller than the electroluminescent layer. Unfortunately, tolerances in the screen printing process and in cutting operations cause a noticeably wide band around the perimeter of each-lamp. Any area not covered by the rear electrode is not luminous and a dark band at the perimeter of an EL lamp is undesirable in many applications. Although a rear electrode may be patterned for other reasons, it is undesirable to pattern the rear electrode for pullback.

In view of the foregoing, it is therefore an object of the invention to provide an EL lamp in which the rear electrode is made smaller than the front electrode without patterning the rear electrode for pullback.

Another object of the invention is to provide an EL lamp in which the rear electrode is smaller than the front electrode and there is an imperceptible dark band around the perimeter of the lamp.

A further object of the invention is to provide a process for cutting an EL lamp on a bevel to reduce the size of the rear electrode.

Another object of the invention is to provide a process for bevel cutting all sides of an EL lamp simultaneously.

SUMMARY OF THE INVENTION

The foregoing objects are achieved in this invention in which an EL lamp has a perimeter that is beveled and said rear electrode is smaller in area than said front electrode due to said bevel. The lamp is made by placing an EL panel on a concave die with the rear electrode in contact with the die and shearing the edge of the lamp at an acute angle. The angle is between 30° and 60° and is preferably 45°. The die has a radius of curvature that is 50–150 times the thickness of the panel to prevent deformation of the panel. For circular or nearly circular lamps, the entire perimeter of the lamp can be cut in a single stroke.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
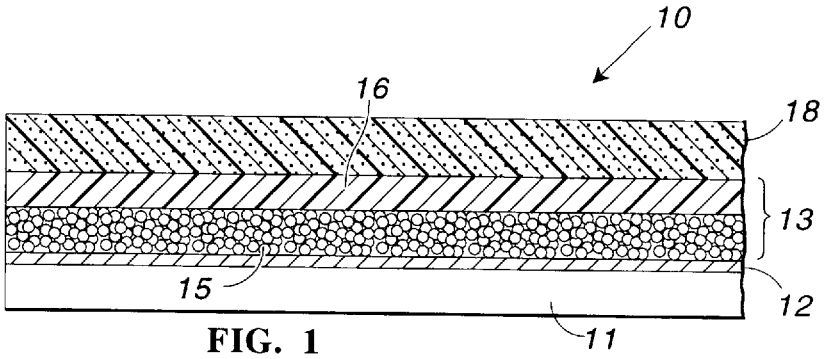
FIG. 1 is a cross-section of an EL lamp.

FIG. 1 is a cross-section of an EL lamp constructed in accordance with the prior art. The various layers are not shown in proportion. In lamp 10, transparent substrate 11 is a sheet of bi-axially oriented plastic such as polyester or polycarbonate. Transparent electrode 12 overlies substrate 11 and is a thin layer of indium tin oxide or indium oxide. ELectroluminescent layer 13 includes phosphor layer 15 and dielectric layer 16. Layers 15 and 16 can be combined in some applications. Overlying dielectric layer 16 is rear electrode 18 containing conductive particles such as silver or carbon in a resin binder.

Substrate 11 typically has a thickness of about 7 mils (0.18 mm) and the screen printed layers each have a thickness of about 2 mils (0.05 mm). Transparent electrode 12 has a thickness of about 1000 A° (100 nm). Thus, the front electrode is separated from the rear electrode by about 4 mils (0.10 mm). Cutting an EL panel rarely produces as clean an edge as indicated on the left side of lamp 10. Typically, the layers are pushed together slightly. In order to increase the separation between the front electrode and the rear electrode, the edge of the lamp is bevel cut, preferably at 30° to 60°.

Figure 2:
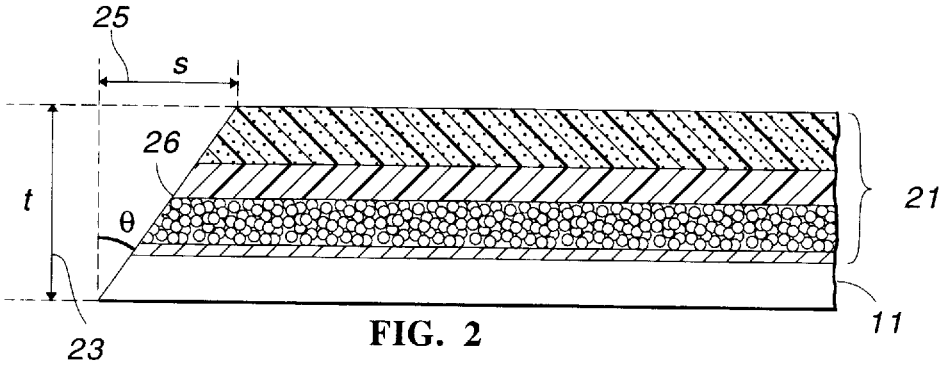
FIG. 2 illustrates the desired pull-back.

FIG. 2 is a cross section of a lamp cut in accordance with the invention. In FIG. 2, the front electrode and the screen printed layers are collectively referred to as lamp materials 21. The combined thickness, t, of substrate 11 and lamp material 21 is indicated by arrow 23. Pullback, s, is indicated in FIG. 2 by arrow 25. As indicated by arrow 25, the pullback is not the distance between the electrodes but is the horizontal component of bevel cut 26. As illustrated in FIG. 2, $s \approx t$, i.e. angle θ (theta) between the bevel and the plane of the lamp is approximately equal to 45°, thereby increasing the separation between the front and rear electrodes by approximately 40% without substantially weakening the perimeter of the lamp.

Figure 3:
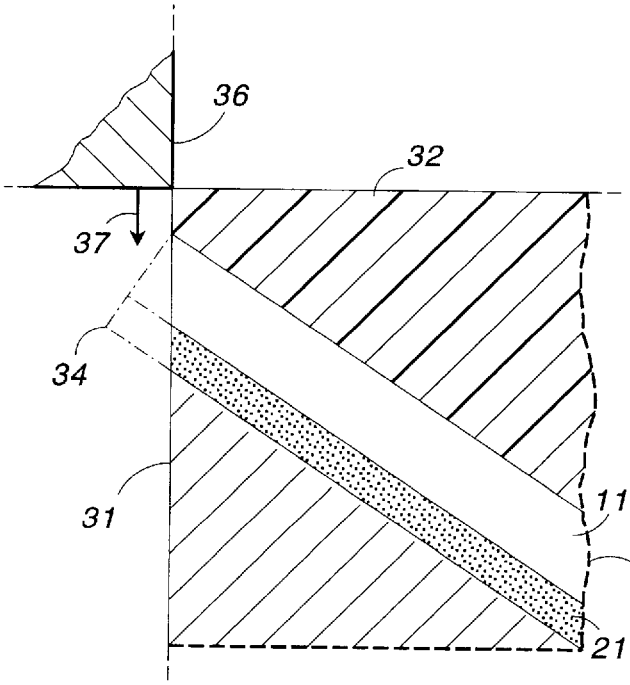
FIG. 3 illustrates cutting a lamp in accordance with the invention.

FIG. 3 is a cross-section of a portion of the apparatus for cutting the edges of lamp 10 on a bevel. Lamp 10 is held between concave lower die 31 and convex upper die 32, with corner 34 protruding from the die. Cutter 36 travels downwardly, as indicated by arrow 37, to shear corner 34 from the remainder of lamp 10. Lamp 10 is positioned between lower die 31 and upper die 32 with lamp materials 21 facing lower die 31.

For circular lamps, the entire perimeter of the lamp can be cut at a bevel in a single stroke and the die has a spherical shape. For non-circular lamps, the die has a cylindrical shape and the lamp is cut in more than one stroke.

Figure 4:
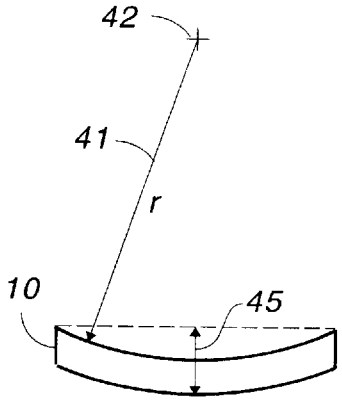
FIG. 4 illustrates the geometry of the cutting operation.

FIG. 4 illustrates the geometry of the die, although not in proportion to the thickness of the lamp. Radius 41 represents the radius of curvature of the upper die and extends from point 42 to the upper surface of lamp 10. The radius of the lower die extends from point 42 to the lower surface of lamp 10. The radii of curvature preferably differ by the thickness of lamp 10. The average radius of curvature is preferably between fifty and one hundred fifty times the thickness of the EL lamp in order to prevent bending the lamp too severely. For example, in one embodiment of the invention, a circular EL lamp having a thickness of 9 mils was cut in a die having an average radius of curvature of 889 mils. The lamp being cut had a diameter of approximately 1000 mils. The pullback was 7 mils.

Cylindrical die for a non-circular lamp can have a smaller radius of curvature because the lamp is not being stretched. The radius of curvature for circular lamps preferably deflects the lamps no more than twenty times the thickness of the lamp. In FIG. 4, deflection 45 is preferably less than or equal to approximately twenty times the thickness of lamp 10 with the maximum deflection varying inversely with the thickness of the lamp. The lamp described above, having a thickness of 9 mils, was deflected 171 mils. Lamps thicker than 9 mils should be deflected less than lamps thinner than 9 mils.

The invention thus provides an EL lamp in which the rear electrode is smaller than the front electrode without patterning either electrode for pullback. The amount of pullback is precisely controlled in the cutting die and the amount of pullback results in an imperceptible dark band around the perimeter of the lamp. The apparatus provides a mechanism for cutting EL lamps on a bevel and, in particular, for cutting EL lamps in a single stroke.

Having thus described the invention, it will be apparent to those of skill in the art that various modifications can be made within the scope of the invention.

What is claimed as the invention is:

1. A method for making an EL lamp having less tendency to short circuit along the perimeter of the lamp, said method comprising the steps of:

providing an EL panel having a front electrode and a rear electrode separated by an electroluminescent layer;

placing the panel on a concave die for holding the lamp at an acute angle relative to a cutter without deforming the panel; and shearing the edge of the lamp whereby the rear electrode is smaller in area than the front electrode due to the angle of the shear.

2. The method as set forth in claim 1 wherein the panel is placed on the die with the rear electrode in contact with the die.

3. The method as set forth in claim 2 wherein said placing step is followed by the step of:

holding the panel in place with a convex member pressed against the panel.

4. The method as set forth in claim 3 wherein the concave die has a radius of curvature that is 50–150 times the thickness of the panel.

5. The method as set forth in claim 1 wherein the lamp is circular and the entire perimeter of the lamp is sheared in a single stroke.

6. The method as set forth in claim wherein the panel is sheared at an angle between 30° and 60°.

7. The method as set forth in claim wherein tie panel is sheared at an angle of approximately 45°.

* * * * *